US006550462B2

(12) United States Patent
Nakamura et al.

(10) Patent No.: US 6,550,462 B2
(45) Date of Patent: Apr. 22, 2003

(54) ENGINE IGNITION SYSTEM

(75) Inventors: Mitsuru Nakamura, Saitama (JP); Kazumi Miyashita, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/000,798

(22) Filed: Dec. 4, 2001

(65) Prior Publication Data

US 2002/0066429 A1 Jun. 6, 2002

(30) Foreign Application Priority Data

Dec. 4, 2000 (JP) ..... 2000-369034

(51) Int. Cl.[7] ..... F02P 1/02
(52) U.S. Cl. ..... 123/601
(58) Field of Search ..... 123/599, 601

(56) References Cited

U.S. PATENT DOCUMENTS 4,181,114 A * 1/1980 Carlsson et al. ..... 123/601
4,709,669 A * 12/1987 Wissmann et al. ..... 123/599
5,392,753 A * 2/1995 Burson et al. ..... 123/406.57
5,931,137 A * 8/1999 McLeod et al. ..... 123/601
6,009,865 A * 1/2000 Herndon et al. ..... 123/601

FOREIGN PATENT DOCUMENTS

JP 63-21739 1/1983
JP 5-42629 4/1986

* cited by examiner

*Primary Examiner*—Erick Solis
(74) *Attorney, Agent, or Firm*—Arent Fox Kintner Plotkin & Kahn

(57) ABSTRACT

In an engine ignition system that includes a rotor that rotates in synchronism with rotation of an engine, an iron core fixedly disposed opposite the outer periphery of the rotor, and a primary coil and a secondary coil that are wound concentrically around the iron core, to reduce the weight of the rotor while allowing the rotational balance of the rotor to be easily adjusted, simplify the arrangement of the rotor itself, and secure an effectively usable space in the region on the inside of the rotor in the radial direction. Permanent magnets are fitted to the iron core having a plurality of legs opposite the outer periphery of the rotor at positions that are spaced in the peripheral direction of the rotor, and an inductor is fixed to the outer periphery of the rotor. The inductor forms a magnetic path for the magnetic flux that is formed by the permanent magnets between pairs of legs. The legs in a pair are adjacent to each other in the peripheral direction of the rotor, and the winding of the primary coil and the secondary coil around the iron core allows a spark plug to be energized every time the inductor passes the pairs of legs.

8 Claims, 10 Drawing Sheets

ENGINE IGNITION SYSTEM

BACKGROUND OF THE INVENTION

1. Field of the Invention

The present invention relates to an improvement of a magnet generator type ignition system, which is used for an engine with comparatively small dimensions.

2. Description of the Prior Art

Conventionally, such an ignition system is known in, for example, Japanese Utility Model Application Laid-open No. 63-21739 and Japanese Patent Application Laid-open No. 542629, in which a permanent magnet is fitted to the outer periphery of a rotor.

The above-mentioned conventional arrangement in which a permanent magnet is fitted to the outer periphery of a rotor has the problems (1) to (3) below. That is to say, (1) in order to maintain the rotational balance of the rotor, it is necessary to fit a counterweight to the rotor on the side opposite to the permanent magnet, the counterweight having a weight that is comparable to the permanent magnet, thereby making the rotor very heavy. Furthermore, (2) it is necessary to arrange the structures of the sections to which the permanent magnet and the counterweight are fitted and the method for fitting them so as to withstand the centrifugal force generated by high rotational speed. Moreover, (3) since there is only a small space inside the sections to which the permanent magnet and the counterweight are fitted, it is difficult to place another component inside the sections to which the permanent magnet and the counterweight are fitted.

The present invention has been conducted under the above-mentioned circumstances, and it is an object of the present invention to provide an engine ignition system that can reduce the weight of the rotor while allowing the rotational balance of the rotor to be easily adjusted, simplify the arrangement of the rotor itself, and secure an effectively usable space in the region on the inside of the rotor in the radial direction.

SUMMARY OF THE INVENTION

In accordance with one feature of the invention, there is provided an engine ignition system that includes a rotor that rotates in synchronism with the rotation of an engine. An iron core is fixedly disposed opposite the outer periphery of the rotor, and a primary coil and a secondary coil are wound concentrically around the iron core. A spark plug can be fired in synchronism with the rotation of the rotor. The permanent magnets are fitted to the iron core having a plurality of legs opposite the outer periphery of the rotor, the legs are positioned so they are spaced in the peripheral direction of the rotor, and an inductor is fixed to the outer periphery of the rotor. The inductor forms a magnetic path for the magnetic flux that is formed by the permanent magnets between a pair of the legs that are adjacent to each other in the peripheral direction of the rotor. The winding of the primary coil and the secondary coil around the iron core enable the spark plug to be energized every time the inductor passes the pair of legs.

In accordance with the above-mentioned arrangement, since the rotor is provided with only the inductor for forming the magnetic path for the magnetic flux generated by the permanent magnets on the iron core side, the weight of the rotor can be reduced and the rotational balance of the rotor can be easily adjusted and, moreover, the inductor can be easily provided on the rotor in comparison with the conventional arrangement in which a permanent magnet is fitted to a rotor. Furthermore, a comparatively large space can be secured in the region on the inside of the rotor in the radial direction, and the space can be used effectively.

Furthermore, there is provided an engine ignition system wherein the iron core is provided with three legs that are spaced at equal intervals in the peripheral direction of the rotor, the permanent magnets are fitted to at least each of the legs on opposite sides along the peripheral direction of the rotor, and the primary coil and the secondary coil are wound around the leg that is in the middle along the peripheral direction of the rotor. In accordance with such an arrangement, the rate of change in the magnetic flux due to the inductor passing over the middle leg among the three legs as the rotor rotates is greater than the rate of change in the magnetic flux due to the inductor passing over two legs when only two legs are provided, thereby giving a high ignition energy.

In accordance with another feature of the invention there is provided an engine ignition system wherein the permanent magnet is mounted within a cutout provided in the iron core, and in accordance with such an arrangement, the permanent magnet can be easily fitted and fixed to the iron core.

In accordance with another feature of the invention there is provided an engine ignition system wherein the permanent magnets are fitted to a face of the iron core, the face being opposite the rotor, and in accordance with such an arrangement, leakage of magnetic flux can be suppressed.

In accordance with another feature the invention there is provided an engine ignition system wherein the inductor projects out of the outer periphery of the rotor toward the iron core, and in accordance with such an arrangement, the inductor can be easily formed.

In accordance with another feature of the invention there is provided an engine ignition system wherein the inductor is formed by fitting a magnetic plate to the outer periphery of the rotor, and in accordance with such an arrangement, the inductor can be easily formed while obviating the need for a die, etc.

In accordance with another feature of the invention there is provided an engine ignition system wherein the inductor is formed by embedding a piece of magnetic plate in the rotor that is made of an aluminum alloy by die casting, and in accordance with such an arrangement, the inductor can be easily formed by simply fitting and fixing the magnetic plate to the rotor that is made of an aluminum alloy, which is a non-magnetic material.

In accordance with another feature of the invention there is provided an engine ignition system wherein the inductor is formed by inwardly recessing a part of the outer periphery of the rotor, and in accordance with such an arrangement, the inductor can be easily formed.

DETAILED DESCRIPTION OF THE PREFERRED EMBODIMENTS

Figure 1:
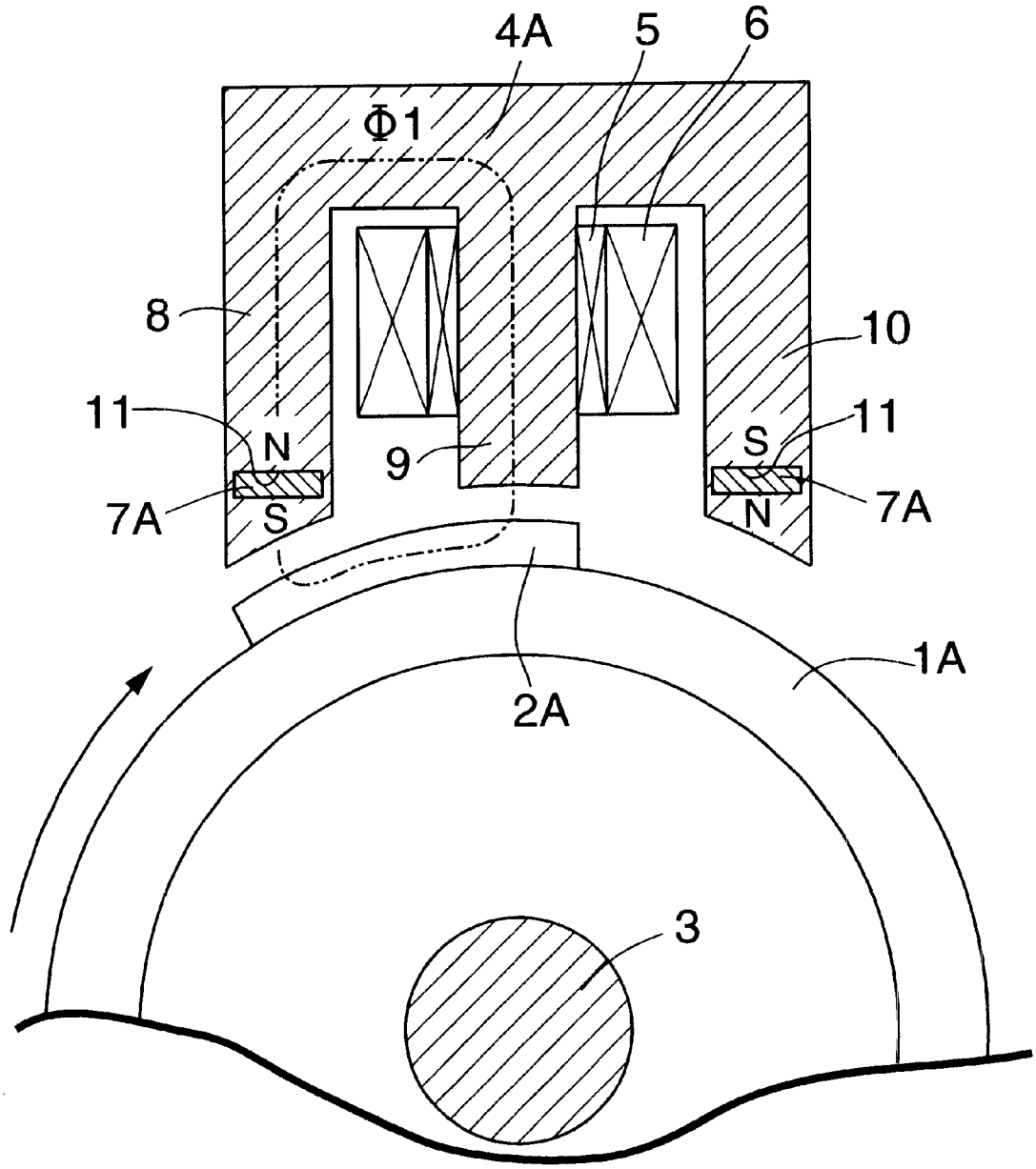
FIG. 1 is a vertical cross sectional side view showing the arrangement of essential parts of an ignition system.

In FIG. 1, a rotor 1A that rotates in synchronism with the rotation of an engine (not illustrated) is coaxial connected to, for example, a cranks haft 3 of the engine. Placed in a fixed position opposite the outer periphery of the rotor 1A is an iron core 4A. Wound concentrically around the iron core 4A are a primary coil 5 and a secondary coil 6, and fitted to the iron core 4A are, for example, a pair of permanent magnets 7A.

The iron core 4A is made in the form of an E shape that is open on the rotor 1A side and has a plurality of legs, for example, three legs 8, 9 and 10 that are opposite the outer periphery of the rotor 1A at positions that are spaced at intervals in the peripheral direction. The iron core 4A is formed by stacking a plurality of iron core laminations that have been stamped by means of a press. The primary coil 5 and the secondary coil 6 are wound concentrically around the leg 9 among the above-mentioned legs 8 to 10, the leg 9 being positioned in the middle along the peripheral direction of the rotor 1A. Each of the legs 8 and 10 positioned on opposite sides along the peripheral direction of the rotor 1A has one of the permanent magnets 7A fitted thereto. The permanent magnets 7A are mounted in corresponding cutouts 11 that are provided close to the extremities of the legs 8 and 10.

For the permanent magnets 7A, it is desirable to use a rare earth magnet having a high magnetic flux density such as, for example, an ND-Fe-B system (neodymium/iron/boron system) magnet.

An inductor 2A is fixedly provided on the outer periphery of the rotor 1A by fitting a magnetic plate to the outer periphery of the rotor 1A. The inductor 2A projects radially outward from the outer periphery of the rotor 1A so as to form a magnetic path for the magnetic flux generated by the permanent magnets 7A between the legs 8, 9 and between the legs 9, 10. The legs in each of the pairs are adjacent to each other in the peripheral direction of the rotor 1A.

That is to say, in a state as shown in FIG. 1 in which opposite ends of the inductor 2A along the peripheral direction of the rotor 1A are opposite one pair of legs 8 and 9 among the three legs 8, 9 and 10 of the iron core 4A, a magnetic path is formed between the two legs 8 and 9 of the iron core 4A and the inductor 2A as shown by the double-dotted dashed line in FIG. 1. When the rotor 1A further rotates from the state shown in FIG. 1 to a state shown in FIG. 2 in which opposite ends of the inductor 2A along the peripheral direction of the rotor 1A are opposite the other pair of legs 9 and 10, among the three legs 8 to 10 of the iron core 4A, a magnetic path is formed between the two legs 9 and 10 of the iron core 4A and the inductor 2A as shown by the double-dotted dashed line in FIG. 2.

Figure 3:
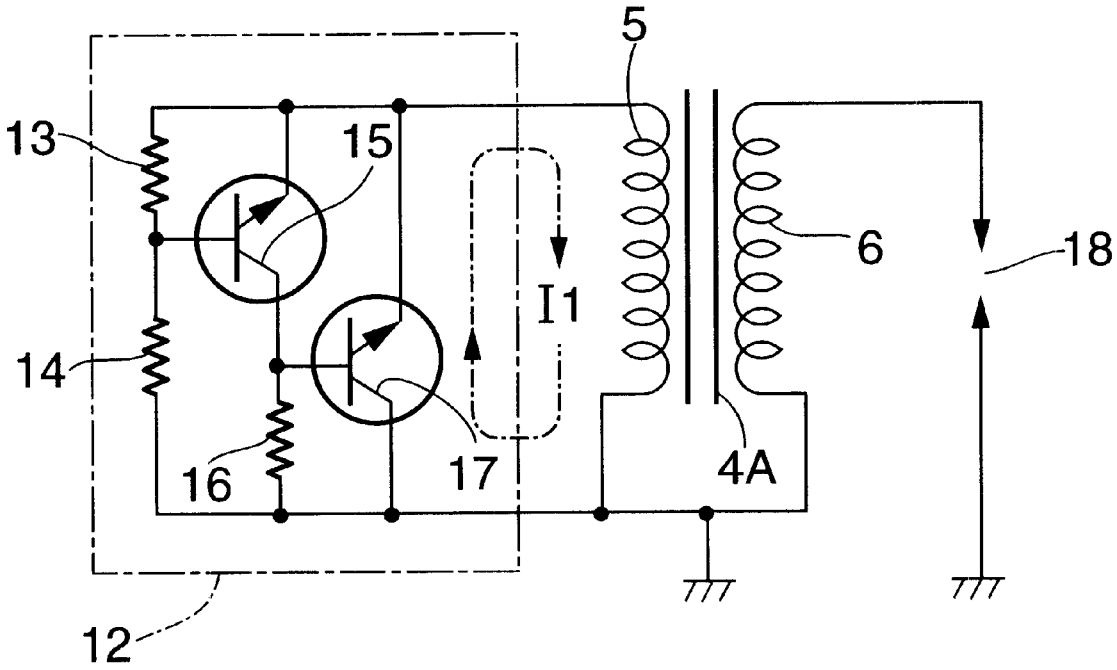
FIG. 3 is a diagram showing an example of a basic arrangement of an electrical circuit for the ignition system.

In FIG. 3, the primary coil 5 is connected to an ignition circuit 12. The ignition circuit 12 has resistors 13 and 14 that are connected in series between opposite ends of the primary coil 5, a series circuit including a transistor 15 and a resistor 16 that are connected in parallel to the resistors 13 and 14, and a transistor 17 that is connected between opposite ends of the primary coil 5. The junction between the resistors 13 and 14 is connected to the base of the transistor 15. The junction between the resistor 15 and the resistor 16 is connected to the base of the transistor 17. The secondary coil 6 is connected to a spark plug 18.

Figure 2:
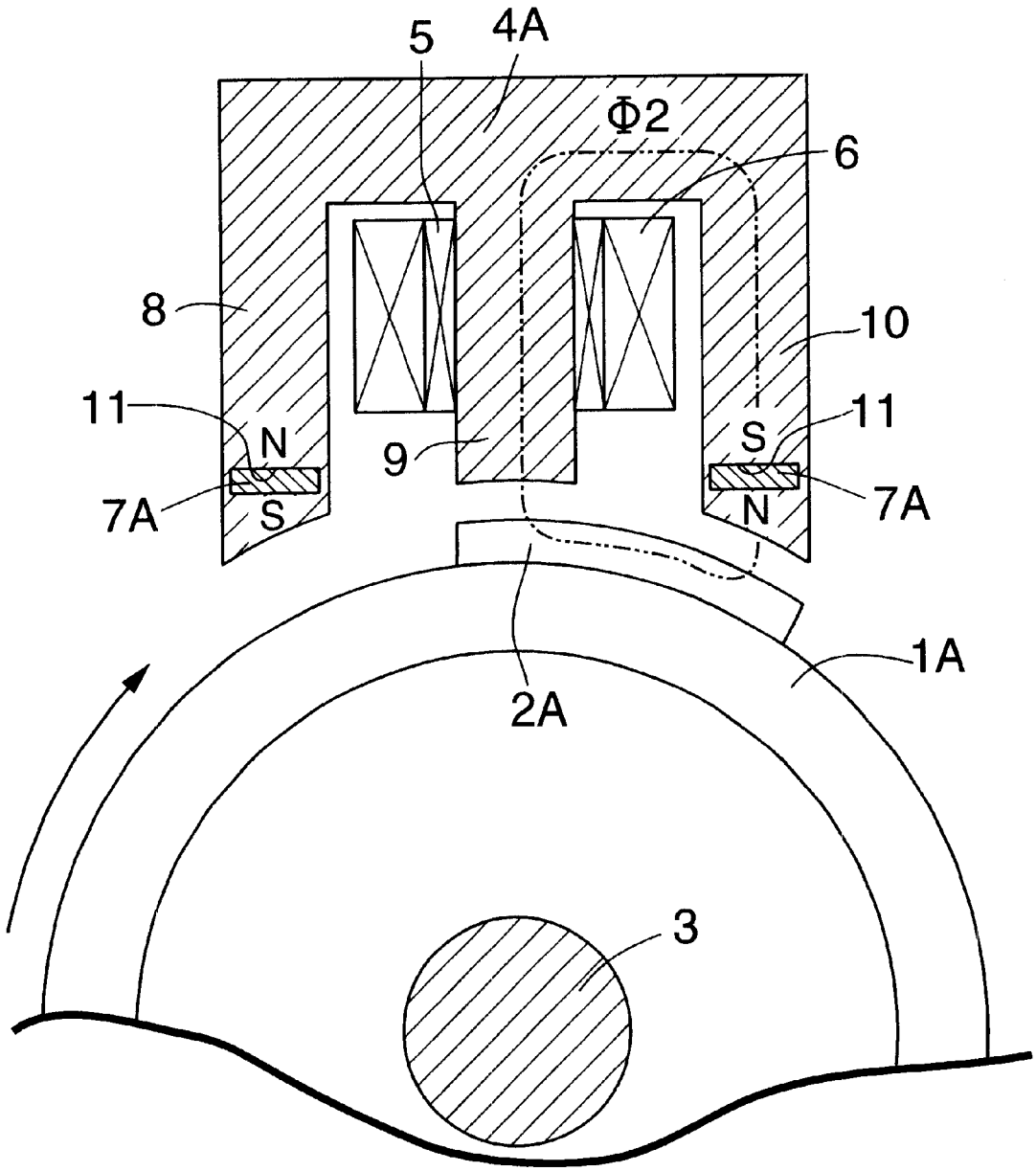
FIG. 2 is a vertical cross sectional side view corresponding to FIG. 1 in a state in which rotation of the rotor has advanced.
Figure 4:
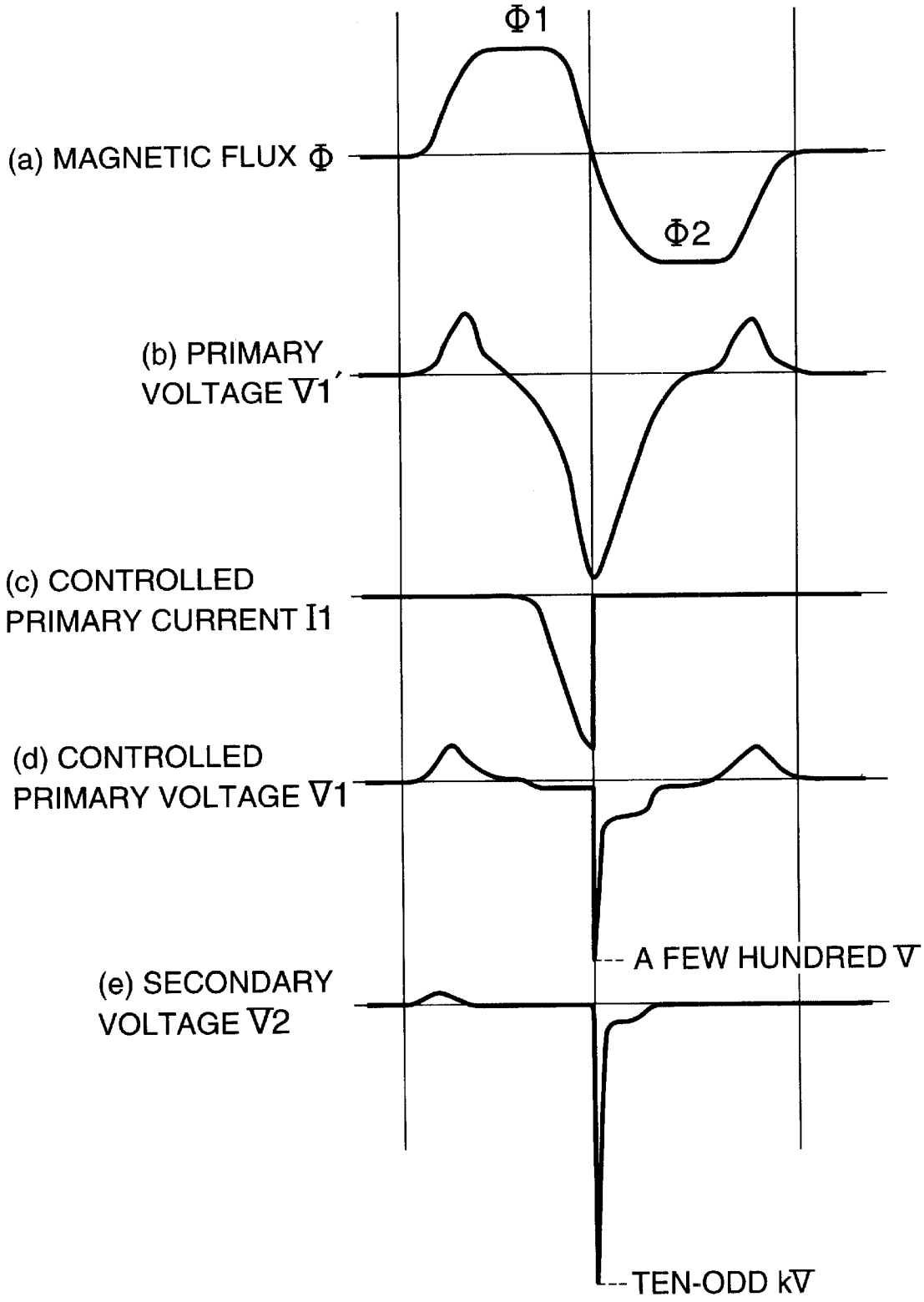
FIG. 4 is a timing chart.
Figure 5:
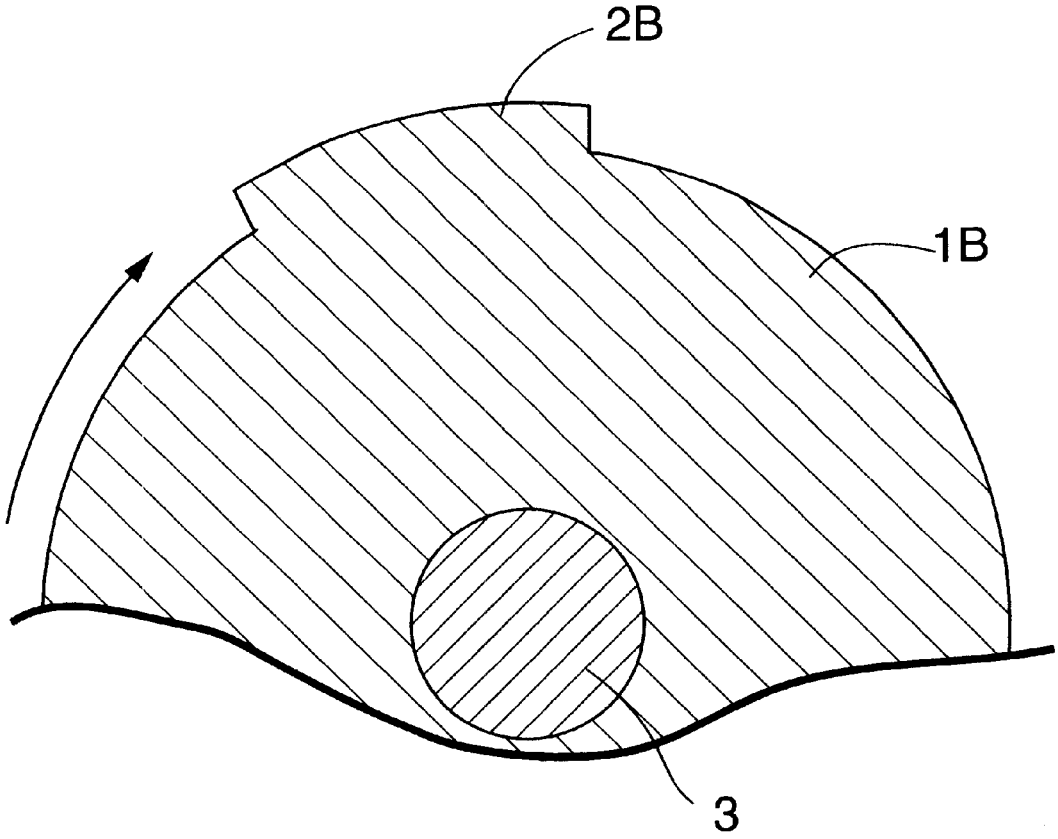
FIG. 5 is a vertical cross sectional view showing a first modified embodiment of the rotor and the inductor.

In the ignition system having such an arrangement, as the relative position between the iron core 4A and the rotor 1A changes from the state shown in FIG. 1 to the state shown in FIG. 2, the magnetic flux $\Phi$ that passes through the primary coil 5 changes from $\Phi 1$ to $\Phi 2$ as shown in FIG. 4(*a*), thereby generating a primary voltage V1' in the primary coil 5 as shown in FIG. 4(*b*).

When the primary voltage V1' increases, the ignition circuit 12 conducts in response to a rise in the base voltage of the transistor 17, and a controlled primary current I1. As shown in FIG. 4(*c*) flows through the primary coil 5. The increase in the primary current I1 raises the potential between the corrector and emitter of the transistor 17, and when the potential reaches a certain set value the transistor 15 starts to conduct, and as a result the transistor 17 is cut off and the primary current I1 that has been passing is rapidly interrupted.

Such a rapid change of the primary current I1 causes a rapid change of the magnetic flux in the leg 9 of the iron core 4A. The leg 9 is wrapped with the primary coil 5, thereby generating a primary voltage VC of a few hundred volts in the primary coil 5 as shown in FIG. 4(*d*). Since the primary coil 5 and the secondary coil 6 are wound concentrically around the leg 9, a secondary voltage V2 is induced in the secondary coil 6 as shown in FIG. 4(*e*) at a level of ten-odd kV according to the ratio of the number of turns thereof to that of the primary coil 5. This secondary voltage V2 is supplied to the spark plug 18, thereby effecting engine ignition.

That is to say, the primary coil 5 and the secondary coil 6 are wound around the leg 9 of the iron core 4A so that the spark plug 18 is energized every time the inductor 2A of the rotor 1A passes the two pairs of legs 8, 9 and 9, 10 among the three legs 8 to 10 belonging to the iron core 4A.

In accordance with the above-mentioned first embodiment, the rotor 1A is provided with only the inductor 2A for forming the magnetic path for the magnetic flux generated by the permanent magnets 7A and 7B that are present on the iron core 4A side; in comparison with the conventional arrangement in which a permanent magnet is fitted to a rotor, it becomes possible to reduce the weight of the rotor 1A and easily adjust the rotational balance of the rotor 1A.

Furthermore, since the inductor 2A only slightly projects radially outward from the outer periphery of the rotor 1A, a comparatively large empty space can be secured in a region on the inside of the rotor 1A in the radial direction and the space can be used effectively.

The iron core 4A has the three legs 8, 9 and 10 that are spaced at equal intervals in the peripheral direction of the rotor 1A. The permanent magnets 7A are fitted to at least two legs 8 and 10 on opposite sides along the peripheral direction of the rotor 1A (the opposite sides alone in this embodiment)

among the above-mentioned legs 8, 9 and 10. The primary coil 5 and the secondary coil 6 are wound around the leg 9 that is in the middle along the peripheral direction of the rotor 1A. As a result, the rate of change in the magnetic flux when the inductor 2 passes over the middle leg 9 among the three legs 8 to 10 as the rotor 1A rotates can be made large, thereby giving a high ignition energy.

Moreover, the permanent magnets 7A are mounted within the cut-outs 11 provided in the two legs 8 and 10 of the iron core 4A, and the iron core 4A is made by stacking a plurality of iron core laminations. Since it is simple to form apertures in the iron core laminations when shaping them by stamping, the apertures corresponding to the above-mentioned cut-outs 11, it becomes easy to fit and fix the permanent magnets 7A to the iron core 4A.

Furthermore, since, as in this first embodiment, the inductor 2A projects toward the iron core 4A from the outer periphery of the rotor 1A, the inductor 2A can be easily formed by, for example, fitting a magnetic plate to the outer periphery of the rotor 1A. Moreover, since the magnetic plate is fitted to the outer periphery of the rotor 1A, the inductor 2A can be easily formed while obviating the need for a die, etc.

FIG. 5 to FIG. 10 show modified embodiments of the rotor and the inductor. In a first modified embodiment shown in FIG. 5, an inductor 2B is formed integrally with the outer periphery of a cast-iron rotor 1B so as to project radially outward from the rotor 1B, and in accordance with this first modified embodiment, the inductor 2B can be easily formed.

Figure 6:
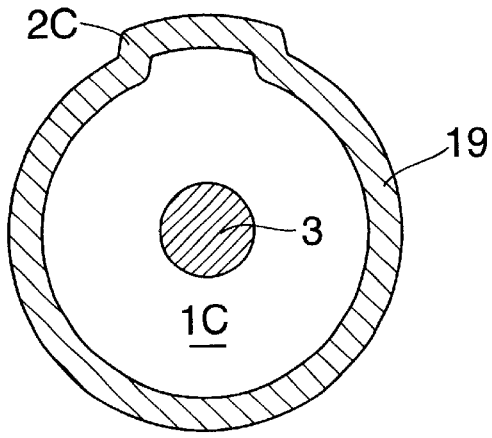
FIG. 6 is a vertical cross sectional side view showing a second modified embodiment of the rotor and the inductor.

In a second modified embodiment shown in FIG. 6, a rotor 1C is formed by press-forming sheet iron in the form of a pan shape having a cylindrical section 19 on its outer periphery and pushing a part of the cylindrical section 19 outward so as to form an inductor 2C on the outer periphery of the rotor 1C.

Figure 7:
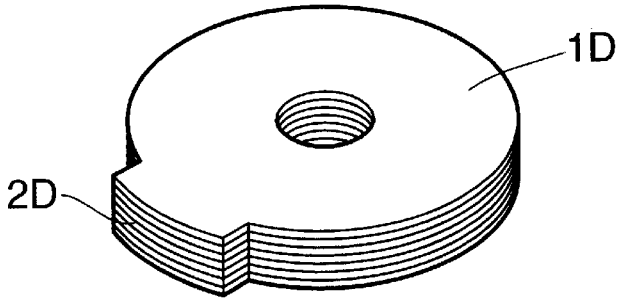
FIG. 7 is an oblique view showing a third modified embodiment of the rotor and the inductor.

In a third modified embodiment shown in FIG. 7, a rotor 1D is formed by stacking magnetic metal sheets stamped by a press, a part corresponding to an inductor 2D being formed simultaneously when stamping each of the magnetic metal sheets. When the rotor 1D is formed by stacking each of the magnetic metal sheets, the inductor 2D can be formed simultaneously so as to project radially outward from the outer periphery of the rotor 1D.

Figure 8:
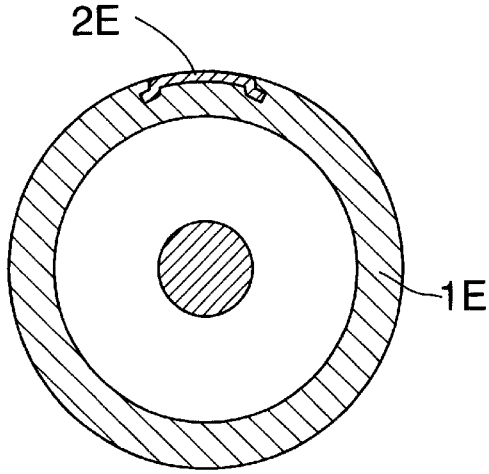
FIG. 8 is a side view showing a fourth modified embodiment of the rotor and the inductor.

In a fourth modified embodiment shown in FIG. 8, a rotor 1E is formed by die casting an aluminum alloy, and an inductor 2E is formed by embedding a part of a magnetic plate in the outer periphery of the rotor 1E. In accordance with this fourth embodiment, the inductor 2E can be easily formed by simply fitting and fixing the magnetic plate to the rotor 1E made of an aluminum alloy, which is a non-magnetic material.

Figure 9:
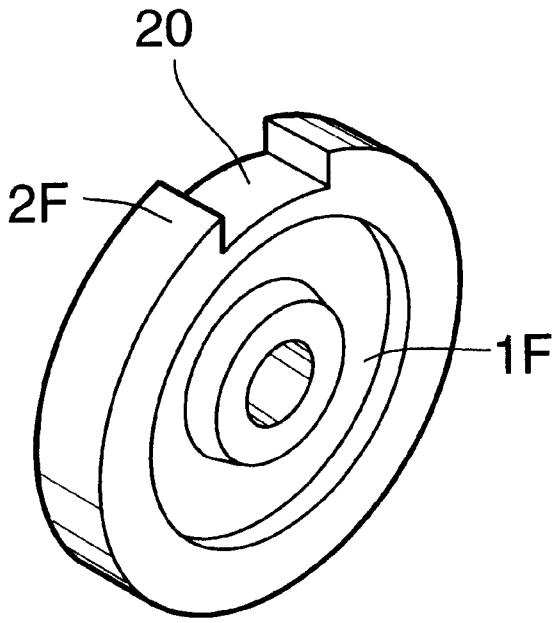
FIG. 9 is an oblique view showing a fifth modified embodiment of the rotor and the inductor.

In a fifth modified embodiment shown in FIG. 9, a recess 20 is formed by inwardly recessing a part of the outer periphery of a cast-iron rotor 1F, thereby providing on the outer periphery of the rotor 1F an inductor 2F employing the recess 20 as its outer surface, and the inductor 2F can thus be easily formed.

Figure 10:
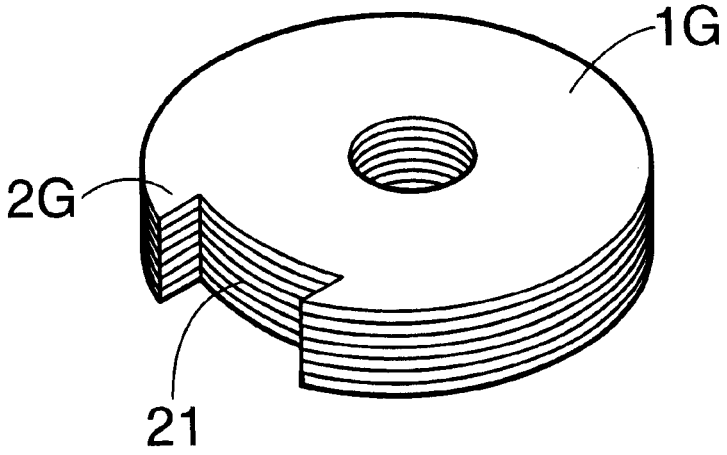
FIG. 10 is an oblique view showing a modified embodiment of the rotor and the inductor.

Furthermore, in a sixth modified embodiment shown in FIG. 10, a rotor 1G is formed by stacking magnetic metal sheets stamped by a press. By forming a part corresponding to a recess 21 simultaneously when stamping each of the magnetic metal sheets the recess 21 can be formed when stacking the magnetic metal sheets to form the rotor 1G. The recess 21 is formed by inwardly recessing a part of the outer periphery of the rotor 1G. An inductor 2G employing the recess 21 as its outer surface is thus provided on the outer periphery of the rotor 1G. In accordance with this sixth modified embodiment the inductor 2G can also be easily formed.

Figure 11:
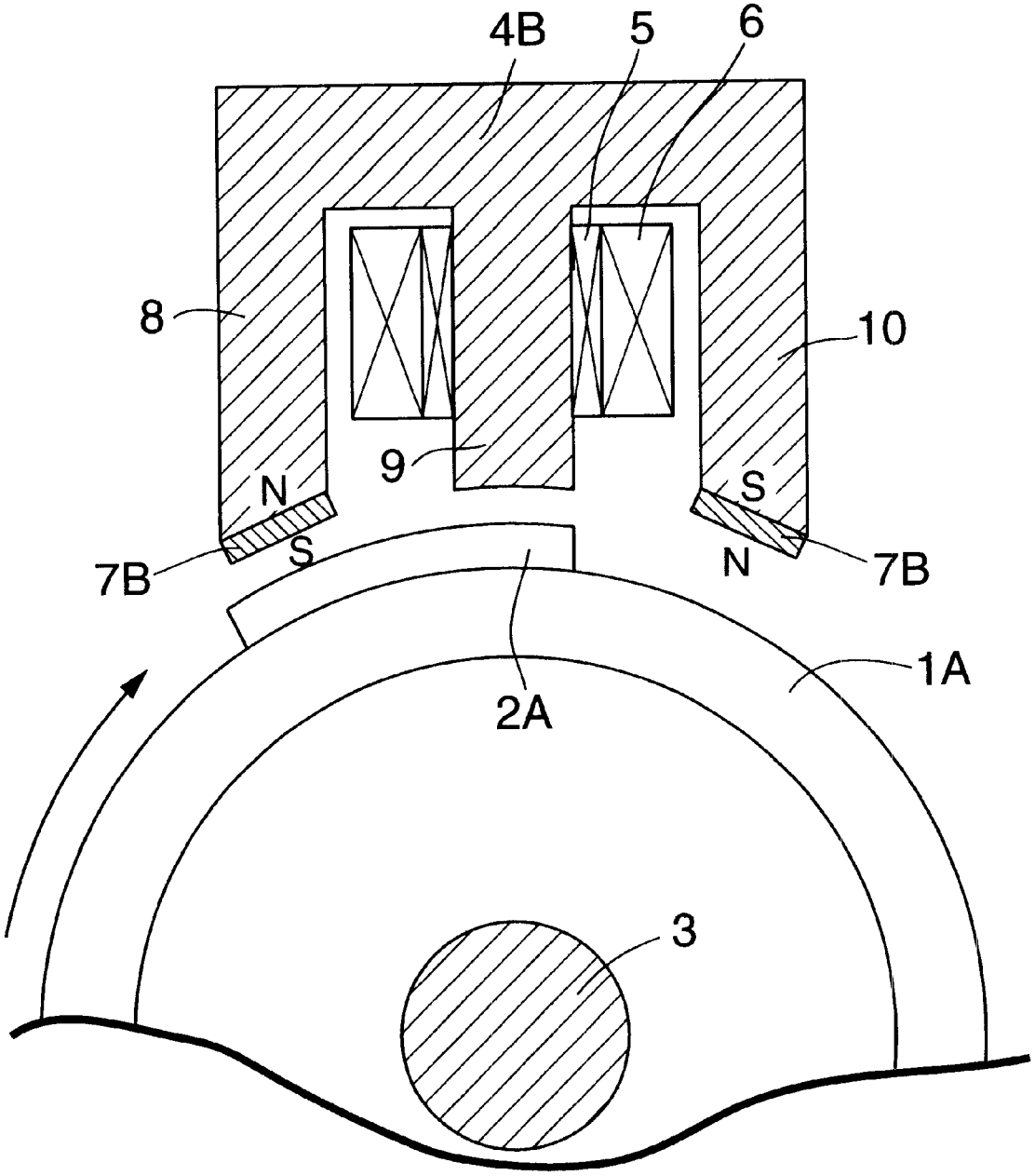
FIG. 11 is a vertical cross sectional side view corresponding to FIG. 1 of one embodiment of the present invention.

FIG. 11 shows a second embodiment of the present invention. An iron core 4B fixedly disposed in a position opposite the outer periphery of the rotor 1A is made in the form of an E shape that is open on the rotor 1A side and has three legs 8, 9 and 10 that are opposite the outer periphery of the rotor 1A at positions that are spaced in the peripheral direction of the rotor 1A. Among the legs 8 to 10 are, the leg 9 that is positioned in the middle along the peripheral direction of the rotor 1A is wound concentrically with a primary coil 5 and a secondary coil 6. Permanent magnets 7B are fitted by, for example, adhesion to the extremity of each of the pair of legs 8 and 10 that are positioned at opposite sides along the peripheral direction of the rotor 1A, that is to say, the faces of the legs 8 and 10 are opposite the rotor 1A.

In accordance with the above-mentioned second embodiment, the leakage of magnetic flux can be suppressed in comparison with the case of the first embodiment in which the permanent magnets 11 are mounted in the legs 8 and 10 of the iron core 4A.

Figure 12:
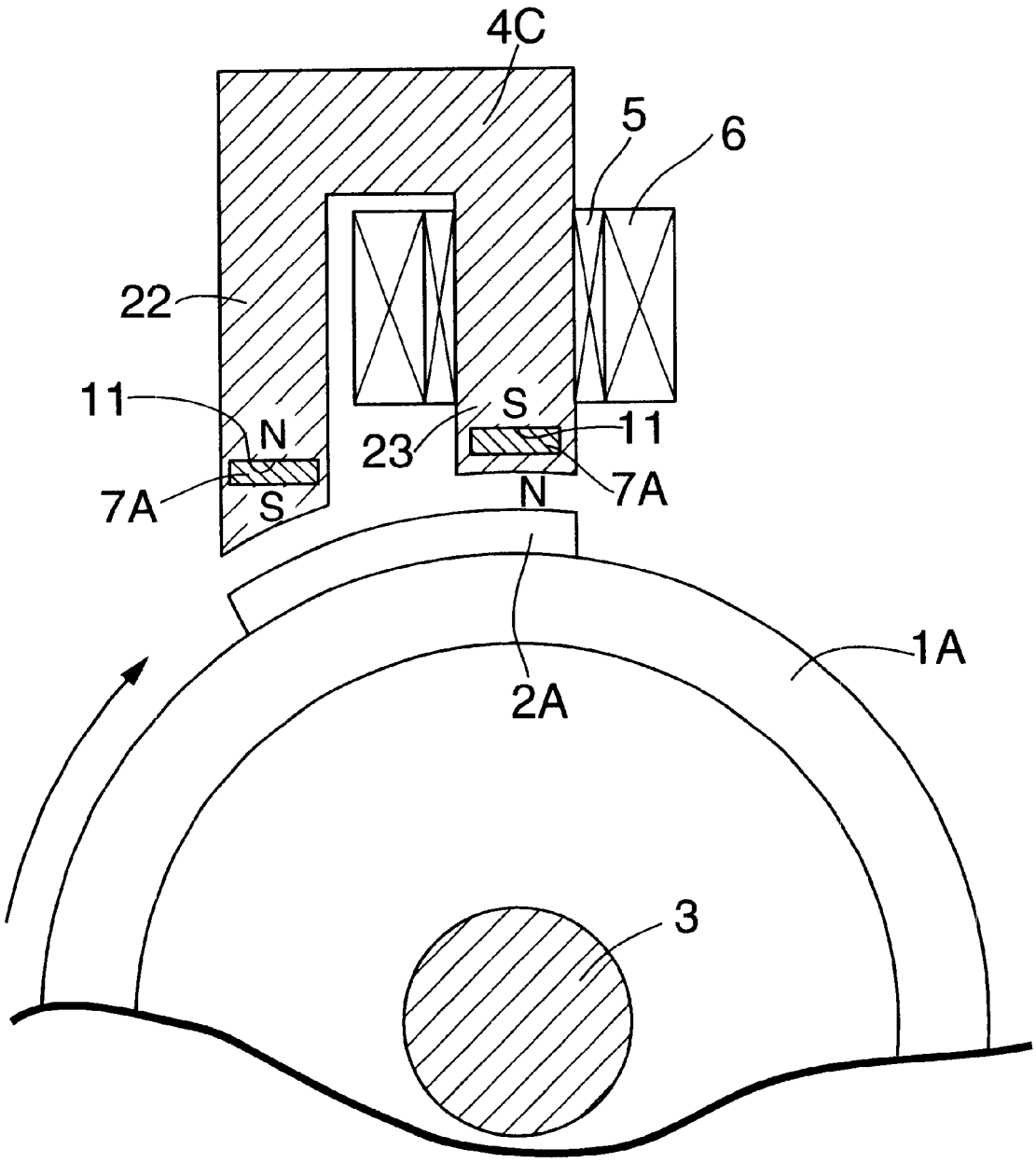
FIG. 12 is a vertical cross sectional side view corresponding to FIG. 1 of another embodiment of the present invention.
Figure 13:
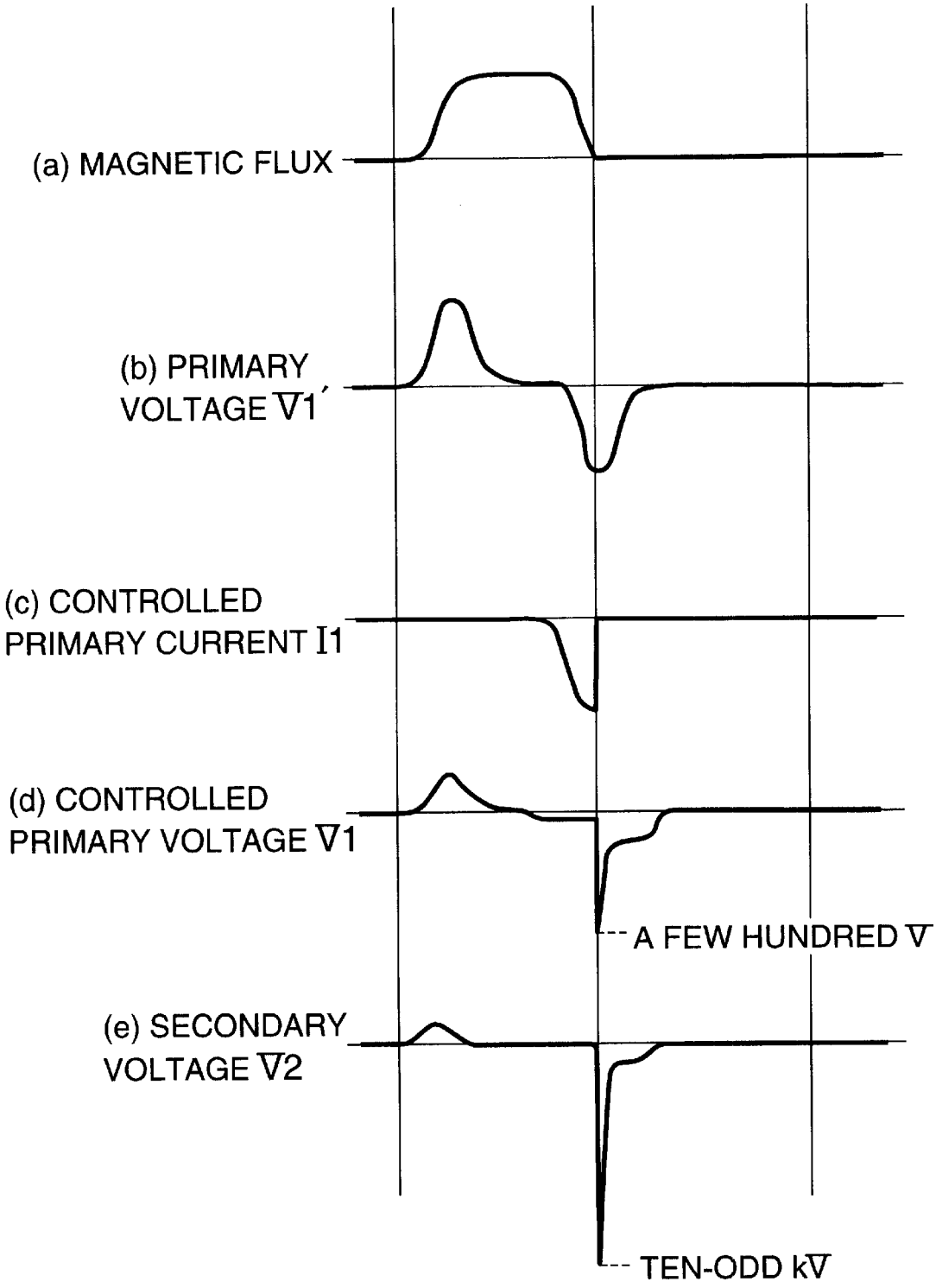
FIG. 13 is a timing chart corresponding to FIG. 4.

FIGS. 12 and 13 show a third embodiment of the present invention, and parts that correspond to those in the above-mentioned embodiments are denoted using the same reference numerals and symbols.

An iron core 4C is fixedly disposed in a position opposite the outer periphery of a rotor 1A. A primary coil 5 and a secondary coil 6 are wound concentrically around the iron core 4C and, for example, a pair of permanent magnets 7A are fitted to the iron core 4C.

The iron core 4C is made in the form of a U shape that is open on the rotor 1A side and has a pair of legs 22 and 23 opposite the outer periphery of the rotor 1A at positions that are spaced in the peripheral direction. The iron core 4C is formed by stacking a plurality of iron core laminations that are stamped by a press. Moreover, cut-outs 11 are provided in areas close to the extremities of the legs 22 and 23, and the permanent magnets 7A are mounted within the cut-outs 11. The primary coil 5 and the secondary coil 6 are wound concentrically around the leg 23 among the two legs 22 and 23.

In accordance with the third embodiment, the magnetic flux $\Phi$ that passes through the primary coil 5 changes as shown in FIG. 13(*a*). A primary voltage V1' shown in FIG. 13(*b*) is accordingly generated in the primary coil 5, and a controlled primary current I1 as shown in FIG. 13(*c*) flows through the primary coil 5. In response to a rapid cut-off of this primary current I1, a primary voltage V1 of a few hundred volts is generated in the primary coil 5 as shown in FIG. 13(*d*). A secondary voltage V2 is induced in the secondary coil 6 as shown in FIG. 13(*e*) at a level of ten-odd kV according to the ratio of the number of turns thereof to that of the primary coil 5.

That is to say, in the arrangement of the third embodiment using the iron core 4C having the two legs 22 and 23, since the rate of change in the magnetic flux $\Phi$ that passes through the primary coil 5 is smaller in comparison with the cases shown in the above-mentioned first and second embodiments in which the iron cores 4A and 4B having the three legs 8 to 10 are used, the ignition energy obtained in the third embodiment inevitably becomes smaller. However, it should be noted that the same effects as those obtained in the abovementioned first and second embodiments can be obtained in the third embodiment.

As hereinbefore described, in accordance with one feature of the invention in comparison with the conventional arrangement in which a permanent magnet is fitted to a rotor the weight of the rotor can be reduced and the rotational balance of the rotor can be easily adjusted and, moreover, the inductor can be easily provided on the rotor. Furthermore, a comparatively large space can be secured in the region on the inside of the rotor in the radial direction, and the space can be used effectively.

Furthermore, in accordance with the one feature of the invention, the rate of change in the magnetic flux due to the inductor passing over the middle leg among the three legs as the rotor rotates is greater than the rate of change in the magnetic flux due to the inductor passing over two legs when only two legs are provided, thereby giving a high ignition energy.

In accordance with the one feature of the invention, the permanent magnet can be easily fitted and fixed to the iron core.

In accordance with the one feature of the invention, leakage of magnetic flux can be suppressed.

In accordance with another feature of the invention, the inductor can be easily formed.

In accordance with another feature of the invention, the inductor can be easily formed while obviating the need for a die, etc.

In accordance with yet another feature of the invention, the inductor can be easily formed by simply fitting and fixing the magnetic plate to the rotor that is made of an aluminum alloy, which is a non-magnetic material.

In accordance with another feature of the invention, the inductor can be easily formed.

Embodiments of the present invention have been described in detail above, but the present invention is not limited to the above-mentioned embodiments and can be modified in a variety of ways without departing from the spirit and scope of the invention described in the appended claims.

What is claimed is:

1. An engine ignition system comprising:

a rotor synchronized to rotate with the rotation of an engine, the rotor having an outer periphery;

a primary coil;

a secondary coil;

an iron core fixedly disposed opposite the outer periphery of the rotor and having a plurality of legs positioned opposite the outer periphery of the rotor and spaced in the peripheral direction of the rotor, wherein the primary and the secondary coil are wound concentrically around the iron core;

at least one permanent magnet fitted to the iron core;

a spark plug, operatively synchronized with the rotation of the rotor; and an inductor fixedly provided at the outer periphery of the rotor, the inductor forming a magnetic path for the magnetic flux generated by the at least one permanent magnet between a pair of the legs adjacent to each other in the peripheral direction of the rotor, wherein winding of the primary coil and the secondary coil around the iron core, energizes the spark plug at time the inductor passes the pair of legs.

2. The engine ignition system according to claim 1, wherein the iron core comprises three legs that are spaced at equal intervals in the peripheral direction of the rotor, and wherein the at least one permanent magnet is fitted to at least each of the legs on opposite sides of the peripheral direction of the rotor, and the primary coil and the secondary coil are wound around a middle leg along the peripheral direction of the rotor.

3. The engine ignition system according to claim 1 or 2, wherein the iron core includes a cutout and wherein the permanent magnet is mounted within the cut-out provided in the iron core.

4. The engine ignition system according to claim 1 or 2, wherein the at least one permanent magnet is fitted to a face of the iron core, the face of the iron core being opposite the rotor.

5. The engine ignition system according to claim 1 or 2, wherein the inductor projects outward beyond the outer periphery of the rotor toward the iron core.

6. The engine ignition system according to claim 5, wherein the inductor comprises a magnetic plate fixed to the outer periphery of the rotor.

7. The engine ignition system according to claim 1 or 2, wherein the rotor is an aluminum alloy and wherein the inductor is a magnetic plate partially embedded in the rotor.

8. The engine ignition system according to claim 1 or 2, wherein the inductor comprises a part inwardly recessing from the outer periphery of the rotor.

* * * * *